US007261579B2

(12) United States Patent
Ku et al.

(10) Patent No.: US 7,261,579 B2
(45) Date of Patent: Aug. 28, 2007

(54) WIRE-TO-BOARD CONNECTOR

(75) Inventors: Hung-Chung Ku, Taipei (TW); Chih-Kai Hu, Taipei (TW); Pin-An Hsieh, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 11/429,236

(22) Filed: May 8, 2006

(65) Prior Publication Data

US 2006/0258213 A1 Nov. 16, 2006

(30) Foreign Application Priority Data

May 13, 2005 (TW) ..... 94115592 A

(51) Int. Cl.
*H01R 25/00* (2006.01)

(52) U.S. Cl. ..... 439/289

(58) Field of Classification Search ..... 439/581, 439/289, 459, 329, 862
See application file for complete search history.

(56) References Cited

U.S. PATENT DOCUMENTS 5,035,641 A * 7/1991 Van-Santbrink et al. .... 439/329
6,048,228 A * 4/2000 Aso ..... 439/660
6,190,210 B1 * 2/2001 Belopolsky et al. ..... 439/676
6,200,174 B1 * 3/2001 Katoh et al. ..... 439/862
6,305,960 B1 * 10/2001 Fan ..... 439/188
6,394,850 B1 * 5/2002 Oliphant et al. ..... 439/660
6,488,543 B2 * 12/2002 Oliphant et al. ..... 439/676
6,524,140 B2 * 2/2003 Takagi et al. ..... 439/700
6,579,128 B1 * 6/2003 Wu ..... 439/676
6,599,152 B1 * 7/2003 Oliphant et al. ..... 439/660
6,659,806 B2 * 12/2003 Shi et al. ..... 439/676

FOREIGN PATENT DOCUMENTS

JP 0899832 * 8/1998

* cited by examiner

*Primary Examiner*—Tulsidas C. Patel
*Assistant Examiner*—Harshad C Patel
(74) *Attorney, Agent, or Firm*—Birch, Stewart, Kolasch & Birch, LLP

(57) ABSTRACT

A wire-to-board connector for coupling electrically a circuit board to a transmission wire unit, includes a plug receptacle, a plurality of signal contacts and a mating header. The plug receptacle is mounted on the circuit board. The mating header includes an insert body that is disposed at one end of the transmission wire unit and that has a plurality of resilient metal elements. When the insert body is plugged into the plug receptacle, the resilient metal elements respectively contact with the signal contacts of the plug receptacle, thereby establishing electrical communication with the circuit board and the transmission wire unit.

12 Claims, 7 Drawing Sheets

WIRE-TO-BOARD CONNECTOR

BACKGROUND OF THE INVENTION (1) Field of the Invention

The present invention relates to an electrical connector, more particularly to a wire-to-board connector for coupling a circuit board electrically to a transmission wire unit.

(2) Description of the Prior Art

Electrical connectors play a major role in the computer industry, because several peripheral devices (such as mouse, monitor, keyboard, printer, network) are coupled to the central processing unit of a computer set via the connectors for data transmission. They are also used for signal transmission between several modules employed in the main system of the computer set. The quality and reliability of the connector may enhance or affect the smooth operation of the entire system of the computer set.

Presently, there are several types of electrical connectors available in the market, namely, board-to-board connector, wire-to-board connector, wire-to-wire connector and etc. Each connector is used for coupling a circuit board electrically to a transmission wire unit. A conventional wire-to-board connector generally includes a plug receptacle and a mating header connected physically to the plug receptacle for establishing a signal communication therebetween.

FIG. 1A shows an exploded view of a conventional wire-to-board that is used for coupling electrically a circuit board 12 to a transmission wire unit 11. The conventional wire-to-board connector generally includes a plug receptacle 14 and a mating header 13. The plug receptacle 14 is mounted securely on the circuit board 12, and has a receiving chamber 140 and a plurality of parallel conductive pins 141 which are in electrical communication with the circuits (not visible) of the circuit board 12 and which project partially into the receiving chamber 140. The mating header 13 is formed with a plurality of parallel through holes 131 for receiving one end portions the transmission wires of the transmission wire unit 11, as best shown in FIG. 1B.

As shown in FIG. 2, when it is desired to couple the circuit board 12 electrically to the transmission wire unit 11, the mating header 13 can be inserted into the receiving chamber 140 in the plug receptacle 14, wherein the conductive pins 141 respectively extend into the holes 131 in the mating header 13 to contact the transmission wires of the transmission wire unit 11, thereby establishing an electrical communication between the circuit board 12 and the transmission wire unit 11.

Some drawbacks resulting from the use of the aforesaid conventional wire-to-board connector are as follows:

(1) It is laborious to assemble manually the mating header 13 and the plug receptacle 14, because the eyes and hands of the assembler must observed continuously in order to align the through holes 131 of the mating header 13 with respect to the conductive pins 141 of the plug receptacle 14; and (2) Un-alignment of the holes in the mating header 13 and unstable handling of the latter may result in collision between the conducting pins 141 and the mating header 13, hence bending and ruin of the conducting pins 141, thereby causing undesired long assembly time and waste of human labor, which in turn, results in low production.

Therefore, the present invention is to find a way to improve the structure of the conventional wire-to-board connector for overcoming the drawbacks encountered during use.

SUMMARY OF THE INVENTION

The object of the present invention is to improve the structure of a wire-to-board connector for effectively and electrically coupling a circuit board to a transmission wire unit.

In one aspect of the present invention, a wire-to-board connector is provided for coupling electrically a circuit board to a transmission wire unit, and includes a plug receptacle, a plurality of signal contacts and a mating header. The plug receptacle is adapted to be mounted on the circuit board. Signal contacts are disposed in the plug receptacle for establishing electrical communication with the transmission wire unit. The mating header is adapted to be disposed at the transmission wire unit and has a plurality of resilient metal elements electrically connecting the transmission wire unit. When the mating header is inserted into the plug receptacle, the resilient metal elements respectively contact with the signal contacts, thereby establishing electrical communication with the circuit board and the transmission wire unit.

In a second aspect of the present invention, a wire-to-board connector is provided for coupling electrically a circuit board to a transmission wire unit, and includes a plug receptacle, a plurality of signal contacts and a mating header. The plug receptacle is adapted to be mounted on the circuit board. Signal contacts disposed in the plug receptacle for establishing electrical communication with the circuit board. The mating header including a plurality of resilient metal elements and an insert body having a first end, a second end and a plurality of parallel channels passing through the first and second ends. Each of the resilient metal elements has a straight metal section received in a respective one of the parallel channels and a bent metal section that is integrally formed with the straight metal section and that is exposed partially from the first end of the insert body 242. The circuit board establishes electrical communication with the transmission wire unit via a respective one of the signal contacts of the plug receptacle, once the insert body is plugged into the plug receptacle.

In a third aspect of the present invention, a transmission wire unit is provided for coupling electrically to a coupling seat mounted on a circuit board, and includes a plurality of core wires, a mating header and an insert body. The mating header includes a plurality of resilient metal elements. The insert body has a first end, a second end and a plurality of parallel channels passing through the first and second ends for receiving first end portions of the transmission wires respectively. Each of the resilient metal elements electrically connects the core wires and has a straight metal section received in a respective one of the parallel channels in contact with a respective the transmission wires. A bent metal section- is integrally formed with the straight metal section and is exposed partially from the first end of the insert body establishes electrical communication with a respective one of the signal contacts of the plug receptacle once the insert body is plugged into the plug receptacle.

BRIEF DESCRIPTION OF THE DRAWINGS

Other features and advantages of this invention will become more apparent in the following detailed description of the preferred embodiments of this invention, with reference to the accompanying drawings, in which.

DESCRIPTION OF THE PREFERRED EMBODIMENTS

Figure 1A:
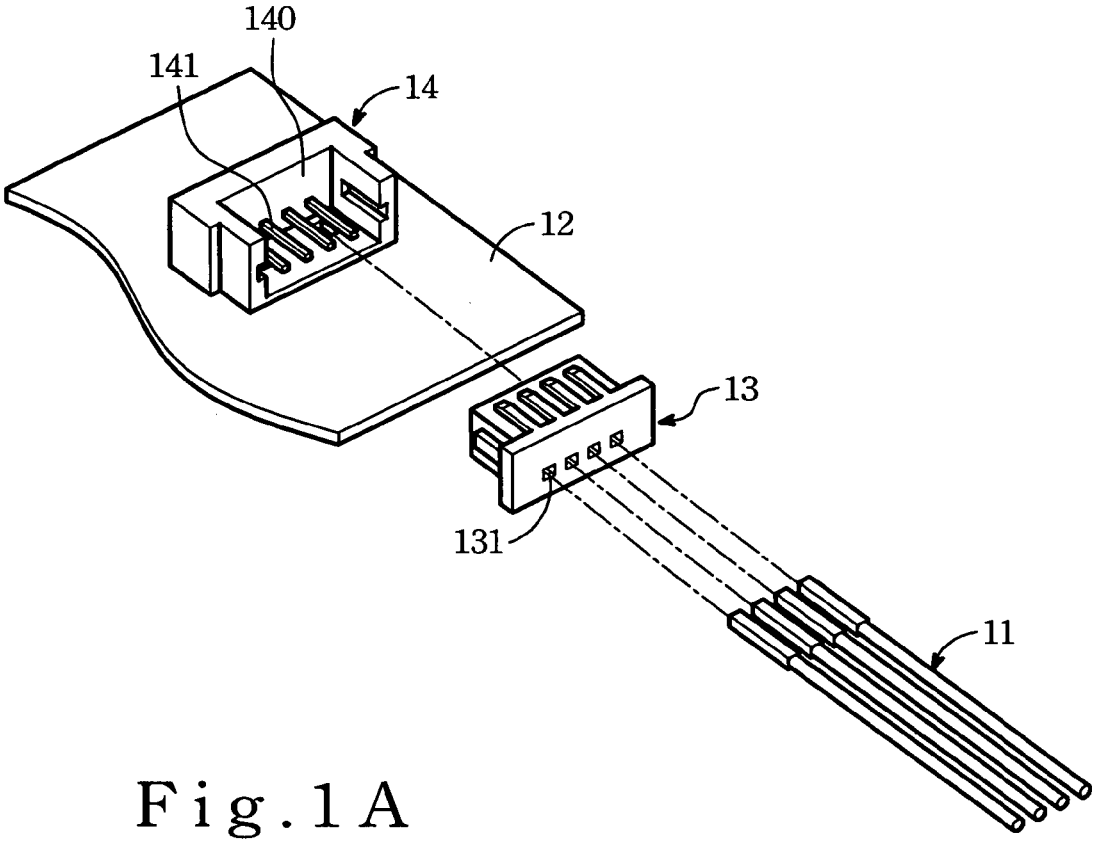
Fig. 1A (Prior Art)
FIG. 1A is an exploded view of a conventional wire-to-board connector for coupling a circuit board electrically to a transmission wire unit.
Figure 1B:
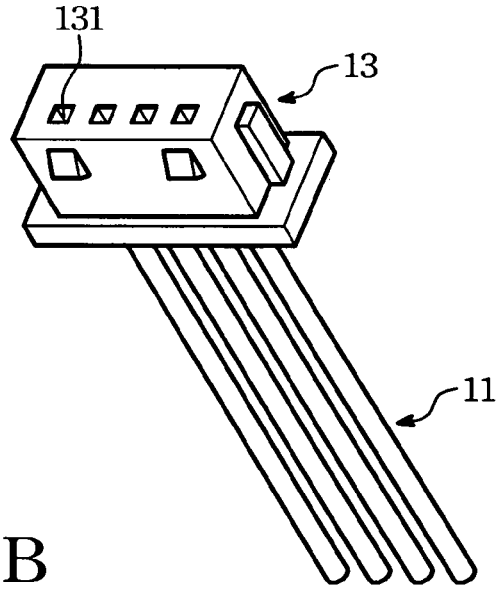
Fig. 1B (Prior Art)
FIG. 1B is a perspective view of a mating header of the conventional wire-to-board connector holding the transmission wire unit.
Figure 2:
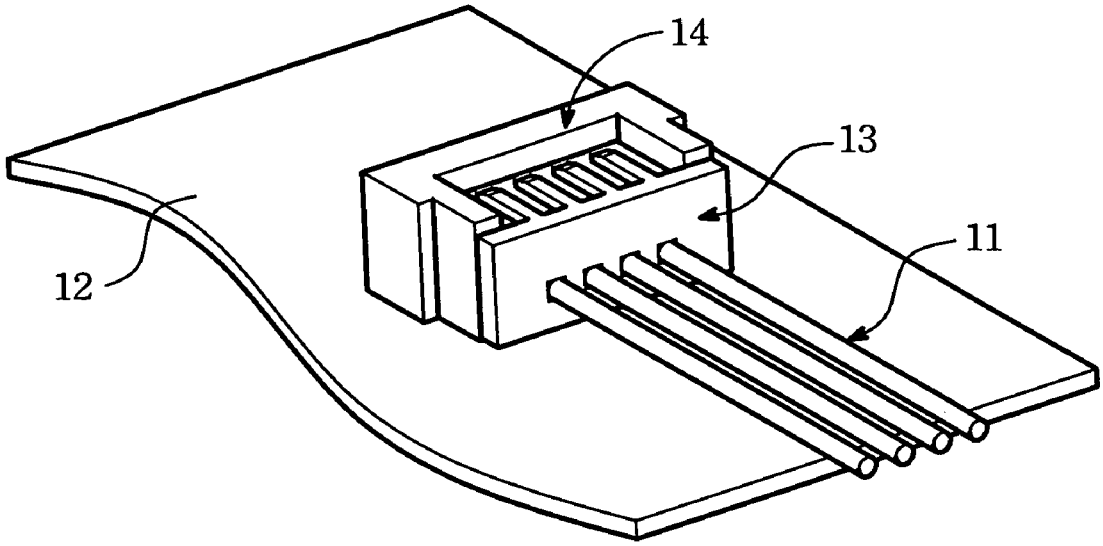
Fig. 2 (Prior Art)
FIG. 2 is a perspective view illustrating how the conventional wire-to-board connector couple the circuit board electrically to the transmission wire unit.
Figure 3A:
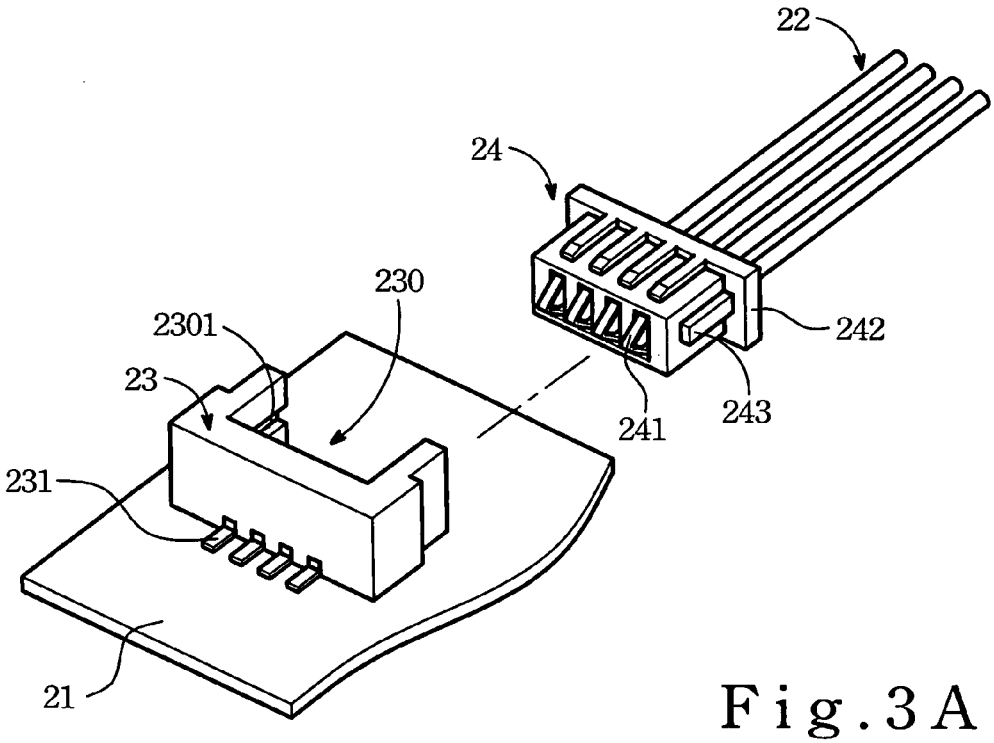
FIG. 3A is an exploded view of the first embodiment of a wire-to-board connector of the present invention for coupling a circuit board electrically to a transmission wire unit.

Referring to FIG. 3A, an exploded view of the first embodiment of the wire-to-board connector of the present invention for connecting a circuit broad 21 and a transmission wire unit 22.

The circuit broad 21 has the circuit pattern and electrical components. In the first embodiment, a printed circuit board is preferred to, but it can be any kind of circuit broads.

The transmission wire unit 22 has a plurality of core wires inside to convey all kinds of signals to several electrical modules, for example, the output signal that comes from the signal output port of an interface card, or the current that comes from the electricity output port of a power module, and etc.

The electrical connector of the present invention includes a plug receptacle 23 disposed on the circuit board 21, and a mating header 24 connected to one end of the transmission wire unit 22. The plug receptacle 23 has a plurality of signal contacts 231. The mating header 24 has a plurality of metal resilient elements 241 for establishing electrical communication with the transmission wire unit 22.

For the better design, the plug receptacle 23 is formed with a receiving chamber 230 that has two position indentations 2301. The mating header 24 has two retention ribs 243 at an exterior thereof. Insertion of the mating header 24 into the plug receptacle 23 results in fixing of the retention ribs in the position indentations. Of course, structures of the position indentations and the ribs can be modified so long it can achieve the goal of fixing the mating header 24 in the plug receptacle 23.

Figure 3B:
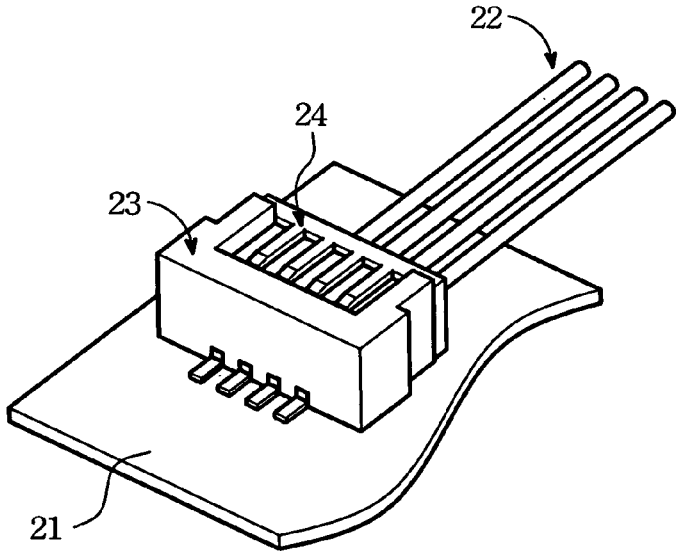
FIG. 3B is a perspective view of the first embodiment of the wire-to-board connector of the present invention for coupling the circuit board electrically to the transmission wire unit.

FIG. 3B shows a condition when the mating header 24 is inserted into the plug receptacle 23. Under this condition, the metal resilient elements 241 contact the signal contacts 231 to permit electrical communication between the transmission wire unit 21 and the circuit board 22.

FIG. 4A to FIG. 5B respectively show the different viewing angles of the plug receptacle 23 and the mating header 24 shown in FIG. 3A.

Figure 4A:
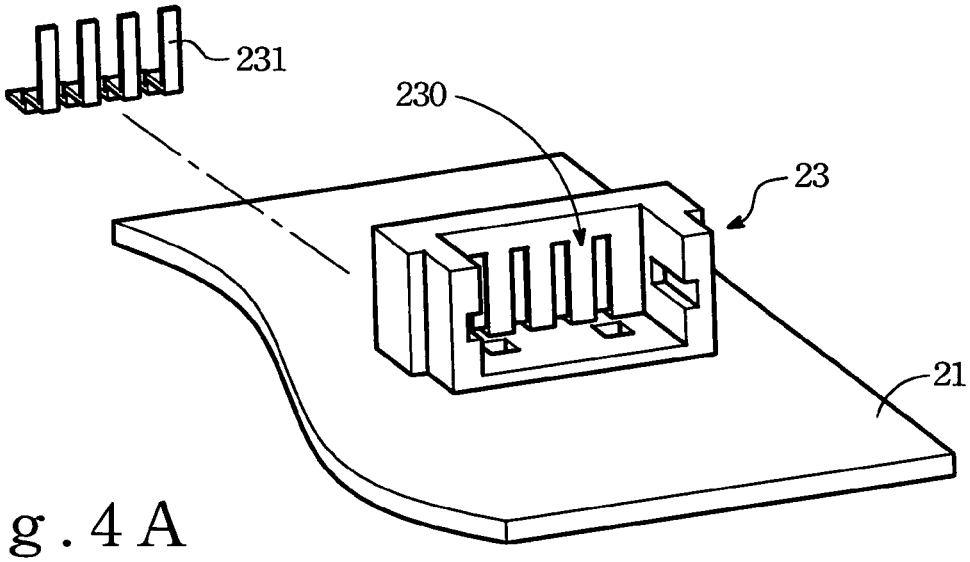
FIG. 4A is an exploded view of a plug receptacle employed in the first embodiment of the wire-to-board connector according to the present invention.

As shown in FIG. 4A, the plug receptacle 23 is disposed on the circuit board 21, and is formed with a receiving chamber 230 that is defined by a chamber-confining wall. The signal contacts 231 preferably are conductive metal strips or parallel conducting pads that are embedded in the receiving chamber 230. Each of the conducting pads has a lower end for fixing on the circuit board 21 by Surface Mount Technology (SMT) such that the lower end of each conductive pad is exposed from the outer surface of the circuit board 21 and is electrically connected to a respective circuit path in the circuit board 21.

Figure 4B:
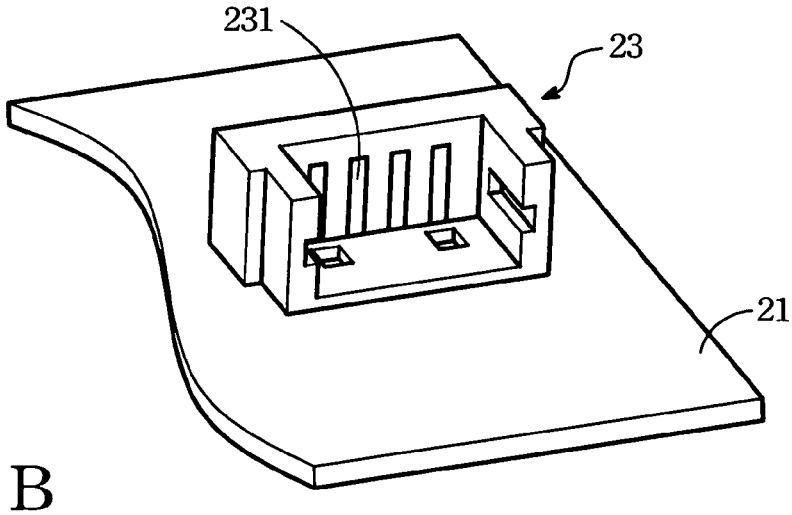
FIG. 4B is a perspective view of the plug receptacle employed in the first embodiment of the wire-to-board connector according to the present invention.

FIG. 4B is a perspective view of the plug receptacle employed in the first embodiment of the wire-to-board connector according to the present invention.

Figure 5A:
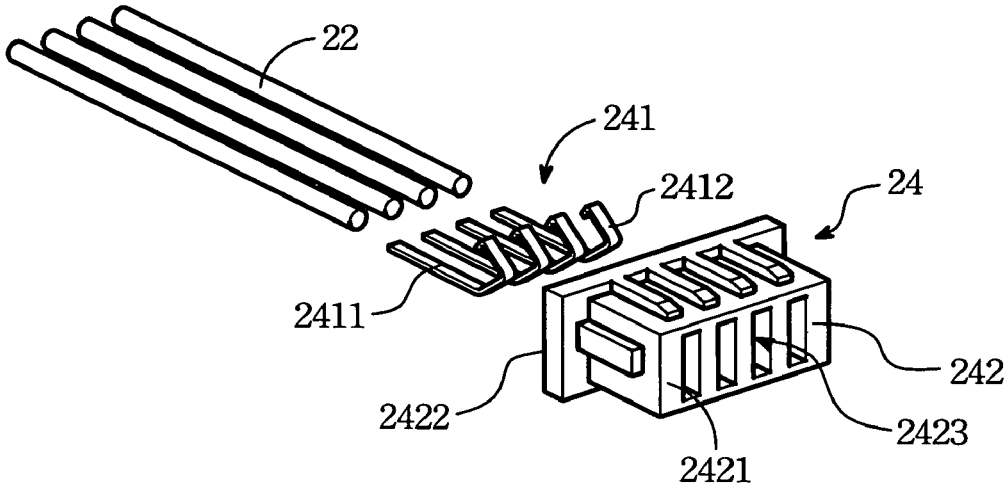
FIG. 5A is an exploded view of a mating header employed in the first embodiment of the wire-to-board connector according to the present invention.

Referring to FIG. 5A, the mating header 24 includes a plurality of metal resilient elements 241 and an insert body 242.

The insert body 242 complements with the configuration of the receiving chamber 230 of the plug receptacle 23. The insert body 240 has a first end 2421, a second end 2422 and a plurality of parallel channels 2423 passing through the first and second ends 2421, 2422. Each of the resilient metal elements 241 is received in a respective one of the parallel channels 2423. Note that the first and second ends 2421, 2422 of the insert body 242 extend parallel to each other.

Each of the resilient metal elements 241 has a straight metal section 2411 received in a respective one of the parallel channels 2423 in the insert body 242, and a bent metal section 2412 that is integrally formed with the straight metal section 2411. Under this condition, the straight metal section 2411 of a respective resilient metal element 241 is in contact with the respective core wires of the transmission wire unit 22.

Figure 5B:
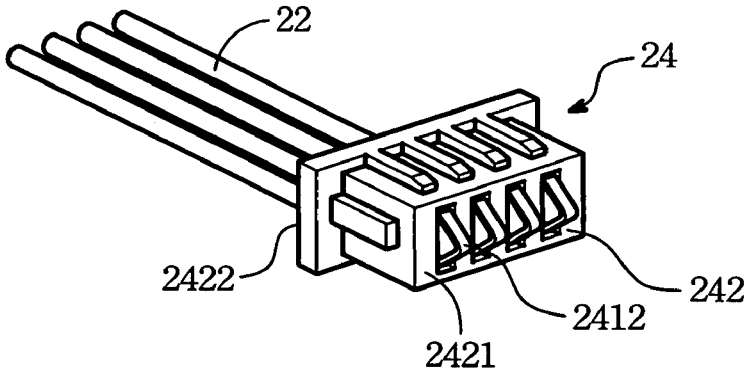
FIG. 5B is a perspective view of the mating header employed in the first embodiment of the wire-to-board connector according to the present invention.

As shown in FIG. 5B, the bent metal section 2412 of each of the resilient metal elements 241 has a V-shaped in configuration, and is exposed partially from the first end 2421 of the insert body 242 so that the bent metal section 2412 has a vertex for establishing electrical communication with a respective one of the signal contacts 231 of the plug receptacle 23 once the insert body 242 is plugged into the plug receptacle 23.

Referring to FIGS. 3A and 3B, and again to FIG. 5B, once the insert body 242 is plugged into the plug receptacle 23, the bent metal sections 2412 of the resilient metal elements 241 are compressed gradually upon contacting the signal contacts 231 of the plug receptacle 23. Later, the bent metal sections 2412 of the resilient metal elements 241 are in tight contact with the signal contacts 231 of the plug receptacle 23 by virtue of its restoration force to provide smooth signal communication between the transmission wire unit 22 and the circuit board 21.

Compared with the prior art, without considering whether the metal resilient elements 241 and the signal contacts 231 employed in the present invention are adjusted accurately, during the process of plugging in, the metal resilient elements or conductors will not oblique due to push in of the mating header 24. Thus, the mating header 24 can be plugged into the plug receptacle easily, thereby enhancing t the efficiency and manufacturing quality of the wire-to-board connector of the present invention.

Figure 6:
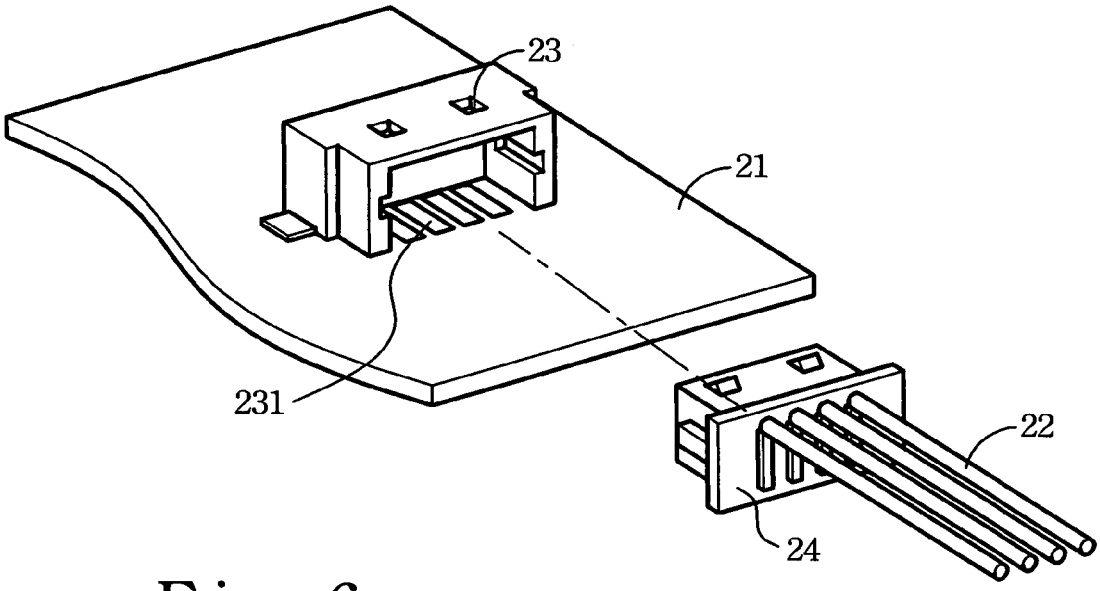
FIG. 6 is an exploded view of another embodiment of a wire-to-board connector of the present invention for coupling the circuit board electrically to the transmission wire unit.

Of course, there are other embodiments for the prevent invention. FIG. 6 shows an exploded view of the wire-to-board connector interconnecting a transmission wire unit 22 and a circuit board 21.

As shown in FIG. 6, the plug receptacle 23 differs from that in the previous embodiment in the receiving chamber 230 is disposed over the circuit board to form a hollow cave between the wall inside the receiving chamber 230 and the surface of the circuit board 21 for the mating header 24 to plug in.

The signal contacts 231, in this embodiment, are naked copper section exposed from the outer surface of the circuit board 21 so as to be shielded by the wall surface confining the receiving chamber 230 of the plug receptacle 23. The naked copper sections define the conductive pads.

Figure 7A:
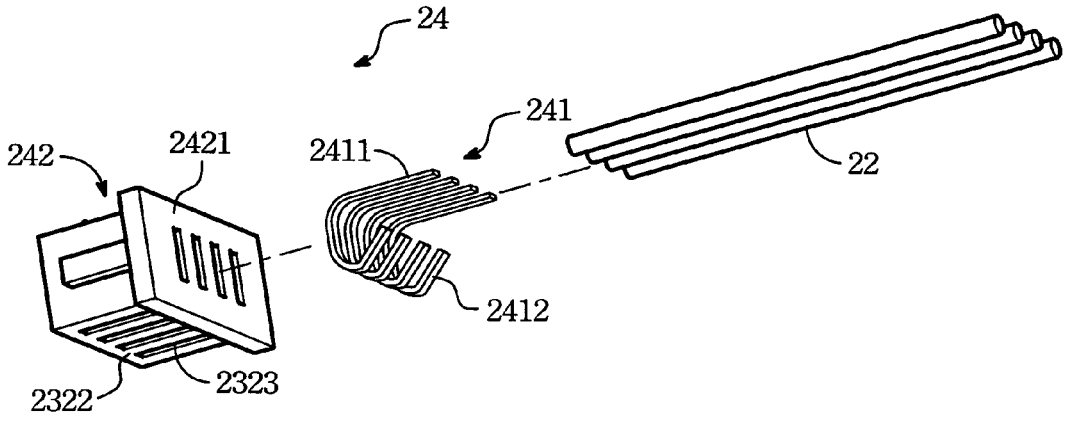
FIG. 7A is an exploded view of a mating header employed in another embodiment of FIG. 6.

Referring to FIG. 7A, an exploded view of the mating header 24 in another embodiment is shown to include an insert body 242 and a plurality of metal resilient elements 241.

The insert body 242 complements with the configuration of the receiving chamber 230 of the plug receptacle 23 so that the the mating header 24 can be fixed therein. The insert body 242 also has a first end 2421, a second end 2422 passing perpendicularly from the first end 2421, and a plurality of parallel channels 2423 passing through the first end 2421 and the second end 2422.

Each of the resilient metal elements 241 has a straight metal section 2411 received in a respective one of the parallel channels 2423 in the insert body 242 and contacting with the respective core wires of the transmission wire unit 22, and a bent metal section 2412 that is integrally formed with the straight metal section 2411 and that is exposed partially from the second end 2422 to the two opposite sides of the insert body 242.

Figure 7B:
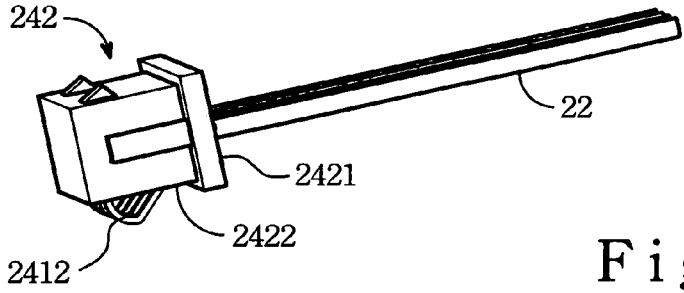
FIG. 7B is a perspective view of the mating header employed in another embodiment of FIG. 6.

FIG. 7B shows an assembled view of the insert body 242 and the transmission wire unit 22.

Similar to that shown in FIG. 6, once the insert body 242 is plugged into the plug receptacle 23, the bent metal sections 2412 of the resilient metal elements 241 are compressed gradually upon contacting the signal contacts 231 of the plug receptacle 23. Later, the bent metal sections 2412 of the resilient metal elements 241 are in tight contact with the signal contacts 231 of the plug receptacle 23 by virtue of its restoration force to provide smooth signal communication between the transmission wire unit 22 and the circuit board 21.

The embodiment above is to illustrate the invention in detail but not to give a specific embodiment. Any modification that doesn't exceed the essence of the invention should belong to this invention. Thus the invention should be safeguarded according to the claims as follows.

We claim:

1. A wire-to-board connector for coupling electrically a circuit board to a transmission wire unit, comprising:

a plug receptacle adapted to be mounted on the circuit board;

a plurality of signal contacts disposed in said plug receptacle for establishing electrical communication with the transmission wire unit; and a mating header adapted to be disposed at the transmission wire unit, and having a plurality of resilient metal elements electrically connecting the transmission wire unit, wherein when said mating header is inserted into said plug receptacle, said resilient metal elements respectively contact with said signal contacts of said plug receptacle, thereby establishing electrical communication with the circuit board and the transmission wire unit;

wherein said mating header includes an insert body having a first end, a second end and a plurality of parallel channels passing through said first and second ends, said first end exposing said resilient metal element and extending in a direction parallel to said second end into which said resilient metal element is inserted.

2. The wire-to-board connector according to claim 1, wherein said plug receptacle is formed with a receiving chamber that is defined by a chamber-confining wall, said signal contacts being conductive metal strips and embedded in such a manner to be exposed from said chamber-confining wall of said receiving chamber.

3. The wire-to-board connector according to claim 1, wherein said plug receptacle is formed with a receiving chamber, said signal contacts being conductive metal strips embedded within the circuit board in such a manner to be exposed from an external surface of the circuit board and shielded by said receiving chamber of said plug receptacle.

4. The wire to board connector according to claim 1, wherein each of said resilient metal elements being received in a respective one of said parallel channels.

5. The wire-to-board connector according to claim 4, wherein each of said resilient metal elements has a straight metal section received in said respective one of said parallel channels and a bent metal section that is integrally formed with said straight metal section and that is exposed partially from said first end of said insert body for establishing electrical communication with a respective one of said signal contacts of said plug receptacle once said insert body is plugged into said plug receptacle.

6. The wire-to-board connector according to claim 5, wherein said bent metal section of each of said resilient metal elements is V-shaped configuration, and has a vertex for contacting said respective one of said signal contacts of said plug receptacle.

7. A wire-to-board connector for coupling electrically a circuit board to a transmission wire unit, comprising:

a plug receptacle adapted to be mounted on the circuit board;

a plurality of signal contacts disposed in said plug receptacle for establishing electrical communication with the circuit board; and a mating header including a plurality of resilient metal elements and an insert body having a first end, a second end and a plurality of parallel channels passing through said first and second ends, each of said resilient metal elements electrically connecting the transmission wire unit and having a straight metal section received in a respective one of said parallel channels and a bent metal section that is integrally formed with said straight metal section and that is exposed partially from said first end of said insert body for establishing electrical communication with a respective one of said signal contacts of said plug receptacle once said insert body is plugged into said plug receptacle, said first end exposing said resilient metal element and extending in a direction parallel to said second end into which said resilient metal element is inserted.

8. The wire-to-board connector according to claim 7, wherein said plug receptacle is formed with a receiving chamber that is defined by a chamber-confining wall, said signal contacts being conductive metal strips embedded within the circuit board in such a manner to be exposed from an external surface of the circuit board and shielded by said receiving chamber of said plug receptacle.

9. The wire-to-board connector according to claim 7, wherein said signal contacts are conductive metal strips, and are disposed on an external surface of the circuit board, said plug receptacle being formed with a receiving chamber that is defined by a chamber-confining wall and that shields said conductive metal strips therein.

10. The wire-to-board connector according to claim 7, wherein said bent metal section of each of said resilient metal elements is V-shaped in configuration, and has a vertex for contacting said respective one of said signal contacts of said plug receptacle.

11. A transmission wire unit for coupling electrically to a circuit board having a plug receptacle with a plurality of signal contacts, the transmission wire unit comprising:

a plurality of core wires; and a mating header including a plurality of resilient metal elements and an insert body having a first end, a second end and a plurality of parallel channels passing through said first and second ends, each of said resilient metal elements electrically connecting the core wires and having a straight metal section received in a respective one of said parallel channels in contact with a respective one of said first end portions of said transmission wires and a bent metal section that is integrally formed with said straight metal section and that is exposed partially from said first end of said insert body for establishing electrical communication with a respective one of said signal contacts of the plug receptacle once said insert body is plugged into the plug receptacle, said first end exposing said resilient metal element and extending in a direction parallel to said second end into which said resilient metal element is inserted.

12. The transmission wire unit according to claim 11, wherein said bent metal section of each of said resilient metal elements is V-shaped in configuration, and has a vertex for contacting said respective one of said signal contacts of the plug receptacle.

* * * * *